US010076700B2

(12) United States Patent
Circo et al.

(10) Patent No.: US 10,076,700 B2
(45) Date of Patent: Sep. 18, 2018

(54) MOUTHGUARD

(71) Applicants: Christopher W. Circo, Omaha, NE (US); Tony Schrager, Omaha, NE (US)

(72) Inventors: Christopher W. Circo, Omaha, NE (US); Tony Schrager, Omaha, NE (US); Xinhua Li, Newton, MA (US); Hootan Farhat, Somerville, MA (US); Noah Tremblay, Pepperell, MA (US)

(73) Assignees: Christopher W. Circo, Omaha, NE (US); Tony Schrager, Omaha, NE (US)

( * ) Notice: Subject to any disclaimer, the term of this patent is extended or adjusted under 35 U.S.C. 154(b) by 79 days.

(21) Appl. No.: 14/292,269

(22) Filed: May 30, 2014

(65) Prior Publication Data

US 2014/0373853 A1 Dec. 25, 2014

Related U.S. Application Data

(60) Provisional application No. 61/926,004, filed on Jan. 10, 2014, provisional application No. 61/838,058, filed on Jun. 21, 2013.

(51) Int. Cl.
*A63B 71/08* (2006.01)
*A63B 71/06* (2006.01)

(52) U.S. Cl.
CPC .... *A63B 71/085* (2013.01); *A63B 2071/0694* (2013.01); *A63B 2207/00* (2013.01); *A63B 2209/00* (2013.01); *A63B 2209/10* (2013.01)

(58) Field of Classification Search
CPC ..... A63B 71/085; A63B 71/08; A63B 71/081; A63B 2071/086; A63B 2071/088; A61F 5/56; A61F 5/566; A61C 9/00; A61C 9/0006; A61C 9/0013; A61C 9/0026; A61C 5/60; A61C 5/62; A61C 5/64; A61C 5/66; A61C 5/68
See application file for complete search history.

(56) References Cited

U.S. PATENT DOCUMENTS

| | | | | |
|---|---|---|---|---|
| 3,224,443 A | | 12/1965 | Monaghan | |
| 4,063,552 A | | 12/1977 | Going et al. | |
| 4,955,393 A | | 9/1990 | Adell | |
| 5,323,787 A | * | 6/1994 | Pratt | A61C 19/063 128/859 |
| 5,406,963 A | | 4/1995 | Adell | |
| 5,596,025 A | * | 1/1997 | Oxman | A61K 6/10 523/109 |

(Continued)

FOREIGN PATENT DOCUMENTS

JP 2010131181 6/2010

OTHER PUBLICATIONS

Supplemental European Search Report for Application No. 14882099.6 dated Jul. 24, 2017, 5 pages.

(Continued)

*Primary Examiner* — Victoria J Hicks
*Assistant Examiner* — Michelle J Lee
(74) *Attorney, Agent, or Firm* — Perkins Coie LLP

(57) ABSTRACT

The present disclosure relates to a dental form comprising at least one first composition and at least one second composition, wherein the at least one first composition and the at least one second composition react when mixed to form a third composition. Also disclosed herein are mouthguards and kits comprising dental forms.

19 Claims, 10 Drawing Sheets

(56) References Cited

U.S. PATENT DOCUMENTS 5,746,221 A 5/1998 Jones et al.
5,816,255 A * 10/1998 Fishman ..... A61C 9/0006 128/861
6,164,278 A * 12/2000 Nissani ..... A61F 5/566 128/848
6,274,122 B1 * 8/2001 McLaughlin ..... A61C 19/063 128/860
6,379,147 B1 4/2002 Georgakis et al.
6,981,874 B2 * 1/2006 Allred ..... A61C 5/00 433/215
7,305,990 B2 12/2007 Mathias
2001/0038997 A1 11/2001 Lindquist et al.
2005/0186150 A1 8/2005 Allred et al.
2006/0130851 A1 * 6/2006 Mathias ..... A61F 5/566 128/861
2006/0269904 A1 * 11/2006 Suchan ..... A61C 9/0006 433/213
2011/0039973 A1 * 2/2011 Kopp ..... A61K 6/005 523/109
2012/0067356 A1 3/2012 Supple
2012/0225402 A1 * 9/2012 Crivello ..... A61C 19/066 433/37
2012/0267811 A1 10/2012 Weitzman
2012/0325224 A1 12/2012 Elkin et al.
2013/0157213 A1 * 6/2013 Arruda ..... A61C 7/08 433/6
2015/0004555 A1 * 1/2015 Frey ..... A63B 71/085 433/6

OTHER PUBLICATIONS

International Search Report and Written Opinion issued in PCT/US2014/072220 dated Apr. 2, 2015.

* cited by examiner

Cross Section of Barrier Bag

Cross Section of Barrier Bag

Mechanical Clip:

Top Side

Bottom Side

MOUTHGUARD

1. FIELD

This Application claims the benefit of priority to U.S. Provisional Application No. 61/926,004, filed Jan. 10, 2014, and U.S. Provisional Application No. 61/838,058, filed Jun. 21, 2013.

The present disclosure relates to a dental form comprising at least one first composition and at least one second composition that react when mixed to form a third composition in the dental form.

Also provided herein are mouthguards prepared by reacting a first composition with at least one second composition to form a third composition in a dental form and kits comprising at least one first composition, at least one second composition, at least one dental form, and an optional external shell.

2. BACKGROUND

Mouthguards used for athletic activity are typically formed of plastic or rubber and engage a user's upper and lower teeth to keep the guard in position. In order to provide a secure fit between the mouthguard and the user's teeth, the mouthguard is imprinted with the wearer's tooth impression. This is commonly done in one of two ways. One inexpensive mouthguard, known as the "boil-and-bite" mouthguard, is partially custom fit by forming a mouthguard blank from a thermoplastic material that is softened at high temperatures and accepts the impression of the wearer's teeth while hot. A fully custom-formed mouthguard may be obtained through one or more appointments with dentist or other dental professional. During the appointments, an impression of the wearer's teeth is molded into plaster. The resulting mold is sent to as manufacturer to produce a mouthguard with a permanent tooth pattern that ensures a sturdy fit in the wearer's mouth. Additional fit adjustments may be performed during follow-up appointments with the dental professional The traditional methods of providing mouthguards are inadequate. Boil-and-bite mouthguards provide an inexpensive, easily formed mouthguard. However, they can be difficult to mold properly because of the properties of the material and the high temperature of the mouthguard when it is inserted for molding. This difficulty often leads to a poor fit for the mouthguard in the athlete's mouth. When the steps are performed incorrectly, the hot material can irritate and even burn the user's lips and gum tissue. Moreover, reboiling the mouthguard can lead to permanent degradation in the performance of the mouthguard, making a miscasting a potentially costly mistake. Custom-formed mouthguards from a dental professional lack reasonable convenience for the casual athletic competitor; requiring one or more appointments to the dental professional's office. Then, the user rarely leaves the office with a complete product, which must be later mailed to the user, or retrieved from the dental professional, after the mouthguard is manufactured. One of the most significant drawbacks to the custom-formed mouthguards, however, is that they can be quite expensive; costing $100 or more. This price point is not an option for many youth participants or more casual athletic competitors.

3. SUMMARY

Given the variance associated with different user requirements, there is a need for individual customized mouthguards that allows for ease of use and that is less expensive.

Generally, it would be desirable for such mouthguards to require a minimal number of steps for the user that can be used in a variety of applications, for example, for athletic users.

In an embodiment of the present disclosure, dental forms are disclosed comprising at least one first composition and at least one second composition that when mixed, react to form a third composition in the dental form. For example, the dental form may comprise an exterior dental shell that when inserted into the user's mouth, can either be discarded or remain adhered to the dental form. In another embodiment, the dental form is self-contained and does not have an exterior dental shell, but is encompassed, for instance, by a flexible membrane that is either rigid or pliant but allows the user to handle with ease.

In another embodiment, the at least one first composition and the at least one second composition are at least partially separated prior to mixing by at least one physical harrier in the dental form. In some embodiments, the dental forms may comprise a plurality of compositions and physical barriers. In at least one embodiment, the dental form comprises a first composition at least partially separated from a second composition by a physical barrier. The individual compositions may comprise reactive resin systems that react to form a solid final resin as the third composition. In some embodiments, the individual compositions comprise at least one indicator that when mixed, produce a new indicator to signal to the user to insert the dental form into the mouth.

In yet another embodiment, multi-compartment kits are disclosed comprising at least one first composition, at least one second composition, a dental form, and optionally at least one exterior dental shell. In some embodiments, the kits may comprise dental forms comprising the at least one first composition and the at least one second composition separated by at least one barrier. In other embodiments, the kits comprise at least one dental form that is subdivided by at least one barrier and is present in its pre-filled state, and separate compartments comprising the at least one first and second compositions.

Methods of using the dental forms and processes of preparing mouthguards are also disclosed. For example, the user can prepare a mouthguard by mechanically disrupting the physical barrier at least partially separating the at least one first and second compositions within the dental form, and allowing the mixed third composition to cure.

DRAWINGS

It is to be understood that both the foregoing general description and the following detailed description are exemplary and explanatory only and are not restrictive of the invention, as claimed.

The accompanying drawings, which are incorporated in and constitute a part of this specification, illustrate one (several) embodiment(s) of the present disclosure and together with the description, serve to explain the principles of the present disclosure.

Figures 4A, 4B, 4C, 4D:
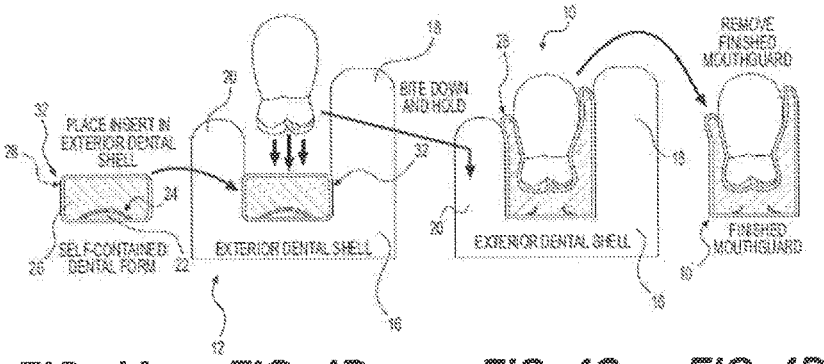

FIG. 4 demonstrates (A) a dental form detached from an exterior dental shell comprising two compositions separated by at least one rupturable membrane; (B) that dental form within a mold channel of an exterior dental shell in an initial state before the two compositions are mixed; (C) two-part composition dental form of FIG. 4(B) after a rupturable membrane has opened, the two compositions have mixed to form a third composition and at least partially surrounded the user's teeth; and (D) removal of the finished mouthguard after the compositions have mixed and are at least partially cured.

Figure 5:
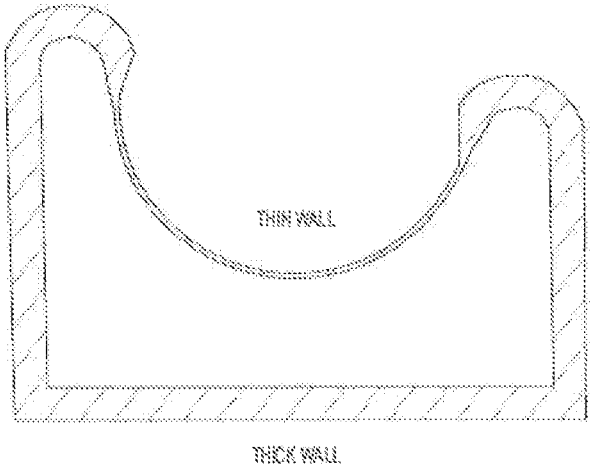

FIG. 5 demonstrates a cross-sectional view of another embodiment wherein the dental form has varied thickness levels at different portions of the dental form.

Figure 6:
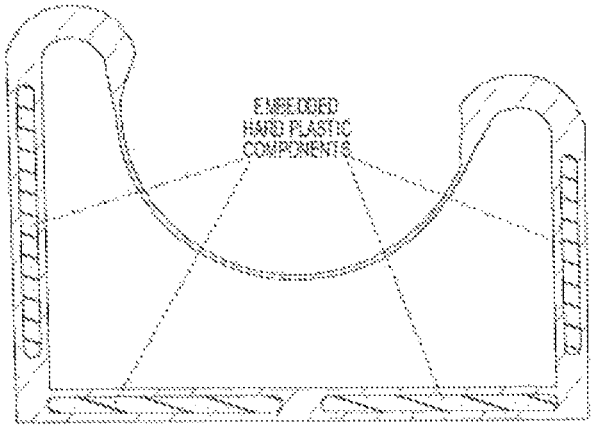

FIG. 6 demonstrates a cross-sectional view of a dental form comprising reinforcement elements embedded into the dental form.

Figure 7:
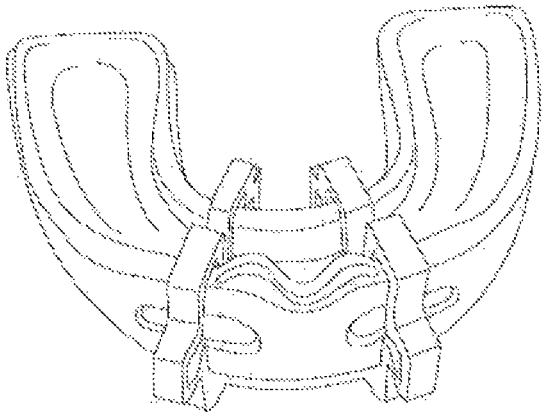
Figure 7:
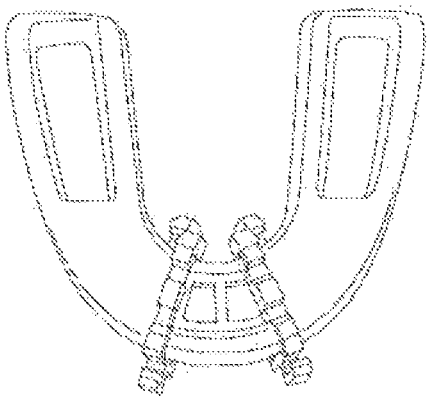
Figure 8:
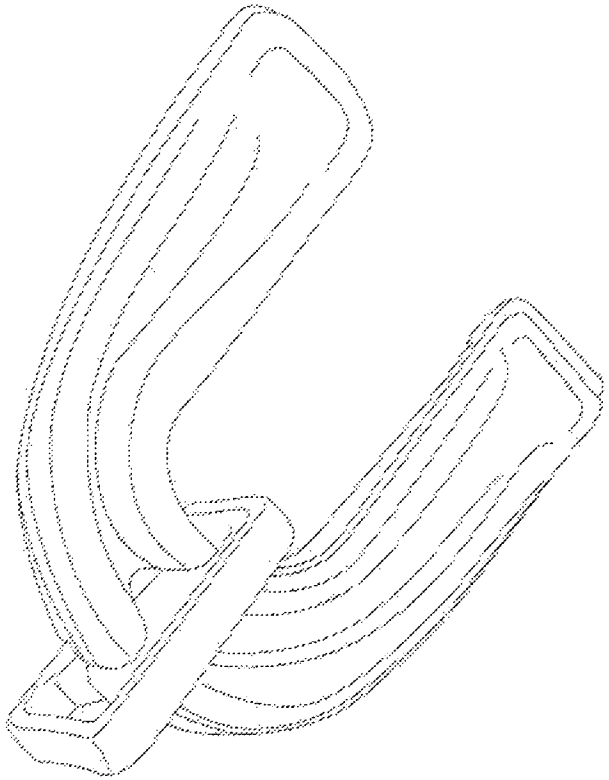

FIG. 7 demonstrates a cross-sectional view of a dental form comprising a mechanical clip, FIG. 8 demonstrates a dental form comprising a mechanical clip separating two compositions.

Figure 9:
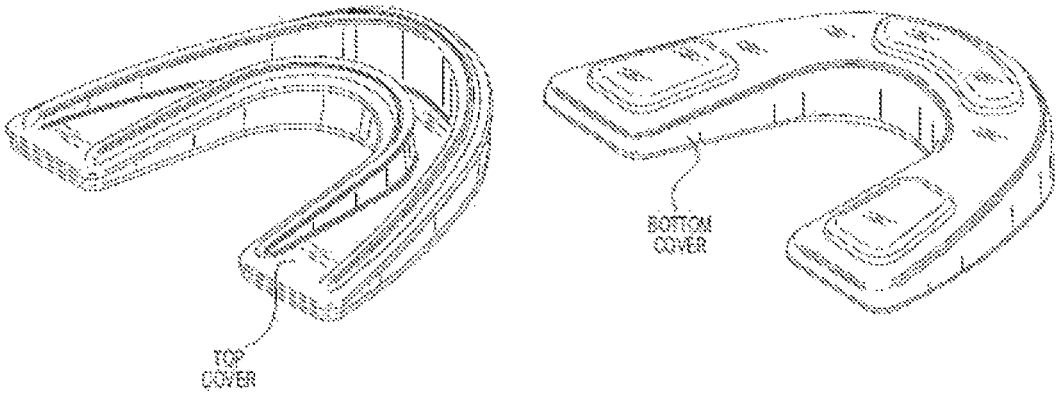

FIG. 9 demonstrates a dental form for the top and bottom arcade of teeth Where the top of the dental form extends upward to receive the user's top teeth and the bottom of the dental form extends downward and is open to receive the user's bottom teeth.

Figure 10A:
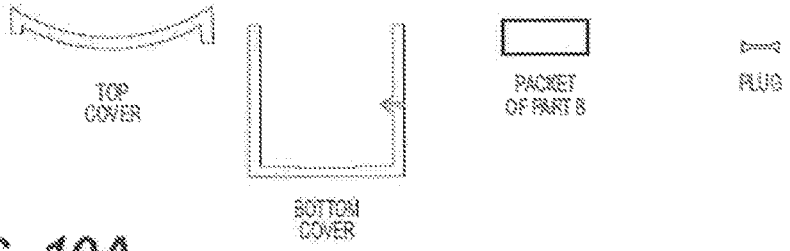
Figure 10B:
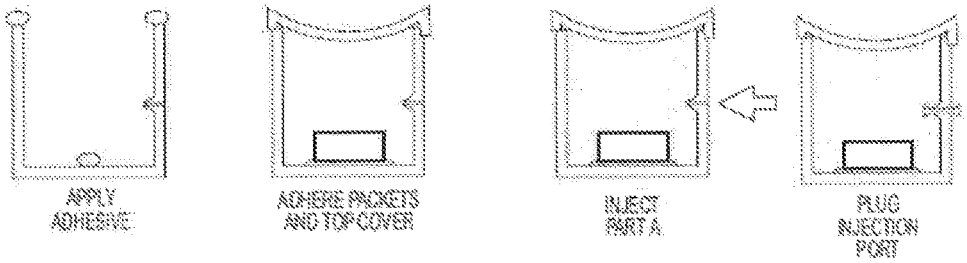

FIG. 10(A) demonstrates a kit comprising: a top cover, a bottom cover comprising a port opening, a packet comprising a first composition, and a plug. FIG. 10(B) demonstrates how the pieces of the kit are manufactured to produce a mouthguard: an adhesive is applied to the rims of the bottom cover and the area in the bottom of the cover where the packet will sit. The packet and the top cover are adhered to the sections containing the adhesive. A second composition is injected into the port opening of the bottom cover and a plug comprising an adhesive is inserted into the port opening to seal the port opening.

DESCRIPTION

Before the present embodiments are described, it is to be understood that the present disclosure is not limited to the particular dental forms, mouthguards, kits, methodologies or protocols described, as these may vary. It is also to be understood that the terminology used in the description is for the purpose of describing the particular versions or embodiments only, and is not intended to limit the scope of the present disclosure which will be limited only by the appended claims.

The terms used herein have meanings recognized and known to those of skill in the art.

As used herein and in the appended claims, the singular forms "a," "a," and "the" include plural references unless the context clearly dictates otherwise. Thus, for example, reference to "dental form" is a reference to one or more dental forms and equivalents thereof known to those skilled in the art, and so forth. Unless defined otherwise, all technical and scientific terms used herein have the same meanings as commonly understood by one of ordinary skill in the art. Although any methods, devices, and materials similar or equivalent to those described herein can be used in practice or testing of embodiments of the present disclosure, the preferred methods, devices, and materials are described below.

As used herein, the term "about," when used in connection with a specific value, means that acceptable deviations from that value are also encompassed. In certain embodiments, the term "about" means that a value higher or lower than the given value by 1%, 3%, 5% 10%, 15%, 20%, 25%, 30%, 35% or 40% is encompassed. For example, the value higher or lower than the given value may range from 5% to 40%, such as from 10% to 35% or from 10% to 20%. In one embodiment the given value may range higher or lower by 20%, 10%, or 5%.

In various embodiments, the at least one dental form comprises at least one first composition and at least one second composition that when mixed, react to form a third composition in the dental form. The dental forms according to the present disclosure may directly adhere to an exterior dental shell or they may be self-contained without the need for an exterior dental shell. The dental form may further comprise a flexible membrane encompassing the at least one first composition and the at least one second composition. The flexible membrane comprises, for example, but is not limited to silicone rubbers such as DUROPRENE, or the silicone rubbers sold under the trade name DRAGON SKIN, such as DRAGON SKIN 10, by Smooth-On, or the resin material sold under the trade name BLUESIL, such as BLUESIL 3040, by Bluestar Silicones; polyurethanes; polycaprolactones, synthetic rubbers; and nylon. Regardless of the material chosen, the flexible membrane is either rigid or pliant but must be sufficiently flexible with a proper tensile strength that it will not rupture under the pressure of the user's teeth, but will flex and allow the encased compositions to surround the user's teeth and gum line. According to the present disclosure, the flexible membrane may have a thickness ranging from about 0.0005 inches to about 0.005 inches.

Figure 1A:
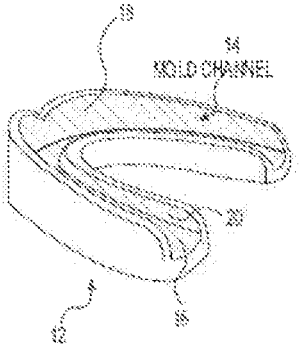
FIG. 1(A) depicts a perspective view of one embodiment of a dental form according to the present disclosure.
Figure 1B:
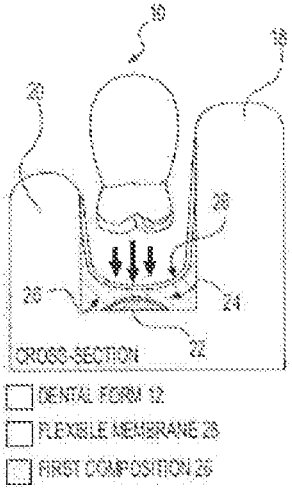
FIG. 1(B) depicts a cross-sectional view of one embodiment of a two-part composition dental form in the initial state before the two-part composition is mixed.
Figure 1C:
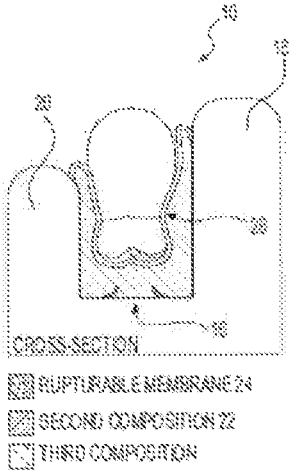
FIG. 1(C) depicts the two-part composition dental form of FIG. 1(B) after a rupturable membrane has opened, the two compositions have mixed to form a third composition and at least partially surrounded the user's teeth.
Figures 2A, 2B, 2C:
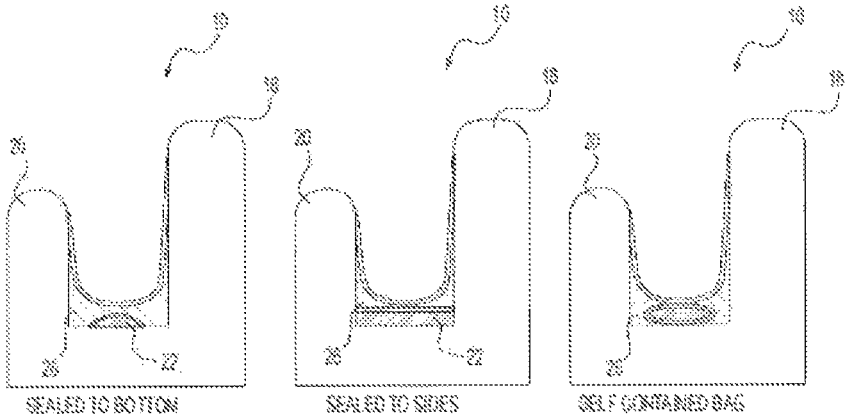
FIG. 2(A) depicts a cross-sectional view of one embodiment of a two-part composition dental form in the initial state before the two-part composition is mixed to form a third composition, wherein a rupturable membrane covers at least one composition, such that a peripheral edge portion of the membrane is adhered to the base wall of an exterior dental shell.
FIG. 2(B) depicts a cross-sectional view of another embodiment of a two-part composition dental form in the initial state before the two-part composition is mixed to form a third composition, wherein a rupturable membrane covers at least one composition, such that peripheral edge portions of the membrane are adhered to the opposing forward and rear walls of an exterior dental shell.
FIG. 2(C) depicts a cross-sectional view of another embodiment of a two-part composition in the initial state before the two-part composition is mixed to form a third composition, wherein a rupturable membrane substantially envelopes at least one first composition in a separate packet that resides within at least one second composition.

The dental form will have a shape that may vary according to the intended use and the shape and of the intended user's mouth. However, with references to FIGS. 1(B), 1(C), and 2(A)-(C), various embodiments of the dental form 10 will be accurately shaped to fill a mold channel of an exterior dental shell, defined by a base wall 16, a forward wall 18 and a rear wall 20. The forward wall 18 and rear wall 20 extend outwardly from the base wall 16 in a spaced apart, generally parallel relationship with one another. Accordingly, in at least one embodiment, the mold channel 14 is shaped to receive an upper arcade of a user's teeth, such as shown in FIG. 1(A), and in another embodiment, may be shaped to receive a lower arcade of a user's teeth, such as shown in FIG. 9.

The dental form may have a consistent thickness level throughout the dental form, or may have varied levels of thickness. With reference to FIG. 5, for instance, the dental form may have thicker walls in areas requiring greater rigidity, such as at the base wall, forward wall, and rear wall(dental shell). In at least one embodiment, the dental form has a thickness of less than or equal to about 2 mm in at least one section of the dental form, such as the thin wall opposite the dental shell in FIG. 5.

With reference to FIG.6, the dental forms of the present disclosure may further comprise at least one reinforcement element, and in at least one embodiment, may comprise a plurality of reinforcement elements, such as at the base wall, forward wall, and rear wall (dental shell). As used herein, the term "reinforcement element" is understood to mean a rigid structural component to reinforce the dental form as needed, for example, to provide an accurately shaped form, or, for instance, to anchor the dental form to an exterior dental shell. Non-limiting examples of the at least one reinforcement element include thermoplastic materials known to those skilled in the art.

The dental forms may have a Shore A hardness less than or equal to about 30, for instance, less than about 25.

In embodiments where the dental form is encompassed within an exterior dental shell, the exterior dental shell may comprise a durable, rigid plastic that is easily moldable during fabrication. A non-exhaustive list of exemplary materials that may be used to construct the exterior dental shell include: poly(ethylene-co-vinyl acetate) (EVA); PMMA; PolyHEMA; and other polymers of like properties. Other rigid materials are contemplated, depending on the intended use of the dental forms including various metals, rubbers, and the like.

The dental forms of the present disclosure may comprise multiple compositions but at a minimum, comprise at least one first composition and at least one second composition that react when mixed to form a third composition. In at least one embodiment, the at least one first and second compositions comprise the same components. In at least one other embodiment, the at least one first and second compositions comprise different components.

The compositions disclosed herein may be present in the dental forms in different proportions. For example, the at least one first composition may be present in an amount ranging from about 1% to about 99% and the at least one second composition may be present in an amount ranging from about 99% to about 1%. In another embodiment, there may be at least three compositions present in the dental from and each one may be present in an amount ranging from about 1% to about 99% to generate a sum total of 100%. According to at least one embodiment, the at least one first composition and the at least one second composition are present in the same proportion, i.e., 50%.

The compositions may comprise at least one reactant component, for instance, reactive resins systems that react to form a solid, final resin. Selection of the resin components will vary dependent upon the intended use of the dental forms taking into consideration parameters such as cure times, strength, weight, cost, shelf life, and the like. In at least one embodiment, the dental forms comprise compositions comprising FDA-approved components.

Reactive resin systems typically contain two liquid or powder components that react to create a solid, final resin. There are two predominant hardening mechanisms: reactive monomer/catalyst, and polymer/crosslinker. In the first mechanism, the polymerization reaction converts the liquid monomer into a hard polymer. An example (non-FDA-approvable) of this type of reaction is the production of epoxy-based resins. In the second mechanism, the crosslinker is a polymer or small molecule that converts a liquid or soluble linear polymer into a solid or insoluble crosslinked polymer. An example of the second mode of reactivity is the production of various polyurethane resins, such as the products sold under the trade name SMOOTH-CAST. For example, in at least one embodiment, the at least one first composition comprises about 10 mL of SMOOTH-CAST 300Q and the at least one second composition comprises about 10 mL of SMOOTH-CAST 300Q.

It is contemplated that several, non-biocompatible materials could be used with the present technology and achieve desirable mechanical attributes for the resulting mouthguards. Examples of such non-biocompatible materials include, but are not limited to, two-part organic resins such as two-part epoxies, two-part polyurethanes, and two-part polyureas. Acrylic polymer systems may be used, where the first composition of the system is an acrylic formulation containing reactive monomers and the second composition contains initiator or activator. Specific examples of such a system include methyl methacrylate, hydroxylethylmethacrylate and radical initiators. Silicone based materials may be used, such as silicone prepolymers that can be cured in situ. In one example, the polymer can be cured by water, for instance, the at least one first composition comprises about 20 mL water and the at least one second composition comprises about 4 mL of ALJA-SAFE BREEZE. In another example, silicones can be rapidly cured by catalyzed hydrosilalation reaction. It is contemplated that some embodiments could use polymer systems using click chemistry/fast crosslinking reactions.

In various embodiments, biocompatible polymers, including polyurethane, silicone and polyethylene glycol, polysaccharide and polycaprolactone can be functionalized with reactive groups including thiol, aclyrate, malimide, alkyne, and azide. In some embodiments thiol is used to functionalize the prepolymer. The prepolymer can be rapidly crosslinked with a multi-acrylate crosslinker in the presence of a catalyst (e.g. an amine, or a phosphine). In other embodiments, the thiol functionalized prepolymer can be crosslinked with malimide containing crosslinker. In still other embodiments, one prepolymer is modified with alkyne and the other prepolymer is modified with azide. The azide and alkyne modified polymers crosslink in the presence of a catalyst.

In at least one embodiment, the multi-part resin may comprise biocompatible materials, for instance, the products sold under the trade name SUPERPASTE, by Bosworth Company. In some embodiments, cement is used. In this embodiment, the first composition comprises metal, semi-metal oxides or metal salts and the second composition comprises water. Specific examples include calcium oxide and water, calcium phosphate and water, and zinc oxide; eugenol and water. Most common cements are non-toxic and are already widely used in dental care; they are created by mixing water with metal or semi-metal oxides. The most familiar type of cement comprises mostly calcium oxide, but there are many different metal oxides and semi-metal oxides (i.e., silicon dioxide) that undergo cement gelation and would be viable options for investigation. Cement gelation proceeds via a mechanism in which water acts as a cross-linker to bridge metal or semi-metal atoms.

In other embodiments, the resin is formed using metal-ion-crosslinked polymers. In these embodiments, the first composition comprises a polyol or polysaccharide and the second composition is an aqueous solution of a multivalent-metal ion such as calcium, zinc, magnesium, aluminum, etc. A specific example is where the first composition is a solution of sodium alginate and the second composition is an aqueous solution of calcium chloride. Other embodiments of the resin are formed using traditional gels. In this embodiment, the first composition comprises a polyol, protein, or other water soluble or dispersible polymer and the second composition comprises water. One specific example is gelatin and water. Some embodiments of the resin may be formed using swellable hydrogels. In these embodiments, the first composition is a crosslinked hydrogel and the second composition is water. One specific example of this is partially crosslinked sodium polyacrylate and water. Other embodiments of the resin may be formed using a borate crosslinked polymer system, in such embodiments, the first composition is polymer containing amines or hydroxyl-groups and the second composition is boric acid or a boric ester. One specific example is polyvinyl alcohol aqueous solution and sodium borate aqueous solution. Still other embodiments of the resin may be formed using clays cross-linked with a biocompatible polymer. In such embodiments, the first composition is a clay particle or a clay particle suspension in water and the second composition is a polycation or a polyanion. One specific example is negatively charged montmorillonite and polylysine. Another embodiment of the resin may be formed using a protein/peptide based formulation where the first composition is a protein or peptide solution and the second composition is a pH modifier. One example is fibrinogen and thrombin. Another example is a carboxylate-containing protein crosslinked by calcium ions.

Metal-ion-crosslinking materials work very differently. In these systems, water soluble polymers, such as sodium alginate, are dissolved in water. A solution of different metal salts is mixed with the water-soluble polymer. The metal ions become bound by hydrophilic functional groups on the polymers, effectively cross-linking the polymer in solution. Instead of the polymer precipitating out of solution, the polymer retains the water and becomes a hydrogel. More broadly, pre-crosslinked hydrogels can be dehydrated and then re-swollen with water to form an expanding solid gel. Here, water could be mixed with hydrogels, like the metal-ion crosslinked type, and solid particles would absorb and swell with water to form a dense material.

In various embodiments, fillers can be added to the compositions disclosed herein to attain the desired mechanical properties. As used herein, "filler" is understood to mean a material that is mixed into the resins or cements, but does not take part in any chemical reaction. Non-limning examples of fillers include metal oxide particles, polymer fibers, silica powders, and mixtures thereof. In at least one embodiment, fillers may be added to impart higher tear strength, for example, cellulose fibers, polymer fibers, carbon fibers, clay, silica, calcium carbonate, calcium phosphate, zinc oxide, and combinations thereof.

At least one optional component may be added to the compositions disclosed herein. For instance, the compositions herein may comprise active agents, lubricants, surfactants, binders, flavoring agents, and combinations thereof, depending on the preference of the manufacturer of the dental forms.

According to the present disclosure, the compositions may further comprise at least one indicator. For instance, the compositions may each comprise different indicators that when mixed create a new indicator. The indicators may be chosen from those known to one of ordinary skill in the art. Non-limiting examples include visual indicators, such as color and luminescent indicators, such as color dyes, organic acids, low pH indicators, metal salts and complementary ligands thereof, light absorbing molecules, fluorescent and phosphorescent emitting molecules, chemiluminescent molecules, and combinations thereof.

In at least one embodiment, the at least one first composition comprises one indicator, for instance, a blue dye, and the at least one second composition comprises a different indicator, for instance, a yellow dye, that when mixed, forms a third color, for instance, a green color in the third composition. In yet another embodiment, the at least one first composition comprises an organic acid indicator and the at least one second composition comprises a low pH indicator, that when mixed, forms a colored salt in the third composition. In another embodiment, the at least one first composition comprises an indicator chosen from metal salts, and the at least one second composition comprises a ligand complementary to the metal salt, that when mixed, forms a colored metal complex in the third composition. According to at least one embodiment, the at least one first composition comprises one indicator chosen from efficient light absorbing molecules, and the at least one second composition comprises an indicator chosen from efficient fluorescent and phosphorescent emitting molecules, that when mixed, forms a new overall fluorescent and/or phosphorescent emission spectrum via fluorescence resonance energy transfer (FRET). In yet another embodiment, the at least one first composition comprises one indicator chosen from chemiluminescent molecules, such as luminol, and the at least one second composition comprises an indicator chosen from oxidizing agents, such as organic peroxide, that when mixed, produces a luminescent third composition.

The at least one first composition and the at least one second composition may be separated in the dental form by the presence of at least one physical barrier. As used herein, the term "separated" is understood to mean that, at a minimum, the at least one first composition and the at least second composition are at least partially separated. However, in at least one embodiment, the at least one first composition and the at least one second composition are completely separated by at least one physical barrier.

According to the present disclosure, the at least one physical barrier may be a rupturable membrane 24, flexible membrane 28, or may be a naturally-formed interface present between the at least first composition and the at least second composition.

In at least one embodiment of the present disclosure, the at least one physical barrier is a rupturable membrane 24. The at least one rupturable membrane may have a lower tear resistance than the at least one flexible membrane. Non-limiting examples of the rupturable membrane include polyesters, polycarbonate epoxies, acrylic polymers, carbohydrates, chitin, chitosan, polystyrenes, polyethylenes, hydrophobic fiber mat, paper, non-woven polymer films, and combinations thereof.

In another embodiment, the at least one physical barrier is a flexible membrane 24. In such embodiments, the flexible membrane of the dental form is compressed, for instance, in the middle of the dental form, to form a subdivided dental form. In another embodiment, the dental form may be twisted or pinched to create the physical separation of the at least first and second compositions. The compression of the flexible membrane forces at least two sections of the flexible membrane to touch, thus producing a physical barrier to separate the at least one first composition and the at least one second composition. According to at least one embodiment, for example as depicted in FIG. 7, the compressed dental form is held in place by at least one mechanical clip. In another embodiment, for example as depicted in FIG. 8, a user may utilize the at least one mechanical clip to compress the dental form to at least partially separate the at least one first and second compositions.

In yet another embodiment, the at least one physical barrier is formed at the interface between the at least one first composition and the at least one second composition. In such embodiments, for example, the at least one first and the at least one second composition naturally form an interface that at least partially separates the compositions.

According to the present disclosure, multi-compartment kits comprise at least one first composition, at least one second composition, at least one dental form, and at least one optional exterior dental shell. The kits may be used to prepare mouthguards, for instance, the kit may comprise at least one dental form filled with the at least one first composition and the at least one second composition at least partially separated by at least one barrier in the dental form, or the kits may comprise at least one dental form subdivided but present in a pre-filled state, with other components of the kits comprising the at least one first and second compositions. The kits may further comprise instructions for application and use. In at least one embodiment, the kits comprise at least one dental form comprising at least one first composition at least partially separated by at least one second composition, an exterior dental shell, and instructions for use. In another embodiment, the compositions are in separate containers within the kit, and the dental form is present in its pre-filled state, but subdivided by at least one physical barrier. In yet another embodiment, the kits may comprise a separate mechanical clip that the user applies to the dental form to subdivide the dental form prior to insertion of the at least one first and second compositions.

In at least one embodiment of the present disclosure, for example as depicted in FIG. 10(A), a kit may comprise a top cover of a mouthguard, a bottom cover of a mouthguard comprising a port opening, at least one first composition within a packet and a plug. While not depicted in FIG. 10(A), the kits disclosed herein may further comprise at least one second composition, at least one adhesive, and at least one syringe. In at least one embodiment, the at least one second composition may be encapsulated in a separate packet from the at least one first composition. As demonstrated in FIG. 10(B), an adhesive is applied to the rims and inside the bottom cover and the packet comprising a first composition and the top cover are adhered to the sections containing the resin. At least one second composition is injected into the port opening of the bottom cover, and a plug comprising adhesive is inserted into the port opening to seal the port opening.

The adhesive in the kits according to the present disclosure may be chosen from adhesives known to one of ordinary skill in the art, for example standard silicone. The packets comprising the compositions may also be chosen from standard plastics known to one of ordinary skill in the art, for instance, polyethylene and polystyrene. In another embodiment, the packets may be metallized, for example, with at least one side of the packet comprising at least one metal, such as aluminum.

Mouthguards may be prepared by processes according to the present disclosure. For examples, the mouthguard may be prepared by contacting at least one first composition with at least one second composition to form a third composition. In some embodiments, the at least one first and second compositions are at least partially separated prior to mixing. Upon mixing, the third composition begins to cure for a period of time until substantially cured, for example, from about 10 seconds to about 10 minutes, such as from about 1 minute to about 5 minutes, for instance, from about 2 minutes to about 3 minutes. In at least one embodiment, the cure time is about 5 minutes. The curing third composition is adhered to the user's upper arcade of teeth or lower arcade of teeth until the curing time is substantially completed, at which time the user can remove the dental form and use the mouthguard. The resulting mouthguard can either be the cured third composition itself, which can be removed from the dental form, or can remain attached to the dental form, optionally adhered to an exterior dental shell.

In at least one embodiment of the present disclosure, the mouthguard is prepared by a) contacting at least one first composition in a dental form with b) at least one second composition in the dental form to form a third composition;

c) placing the third composition in a user's mouth;

d) curing the third composition for a period of time;

wherein the at least one first and second compositions are at least partially separated in the dental form prior to mixing.

In yet another embodiment, the user may insert the dental form into the user's mouth such that the upper arcade of teeth or lower arcade of teeth are received within the mold channel of the dental form. The user ruptures the at least one physical barrier in the dental form by biting down on the dental form. In another embodiment, the user ruptures the at least one physical barrier in the dental form by pinching the dental form prior to insertion into the user's mouth. In yet another embodiment, the user ruptures the at least one physical barrier by removing a mechanical clip from the dental form prior to insertion into the user's mouth. Regardless of the mechanism for removing the physical barrier(s), once the physical barrier(s) is removed, the at least one first composition and the at least one second composition are mixed together in the dental form to form a third composition. The mixing may occur simply after removal of the physical barrier(s) or, in at least one embodiment, by the user physically agitating the dental form for approximately 30 seconds. Once thoroughly mixed, the third composition cures over a period of time adjacent to the user's teeth, for example, from about 10 seconds to about 10 minutes. The mouth card is formed upon completion of the curing step.

Figure 3:
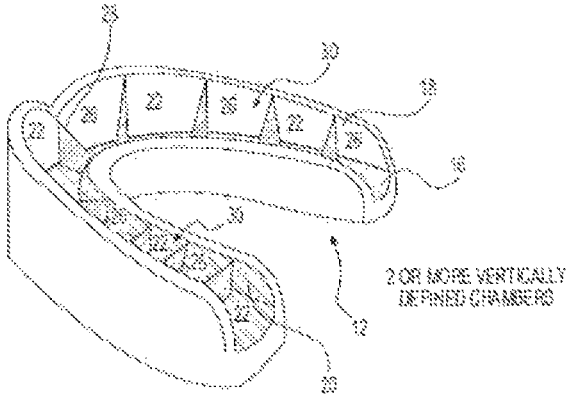
FIG. 3 depicts a perspective view of a multiple two-part composition dental form, wherein a series of successive composition chambers are positioned within a mold channel of an exterior dental shell, separated by individual membrane dividers, in an initial state before the two-part compositions are mixed.

In at least one embodiment of the present disclosure, for example as depicted in FIG. 3, a dental form comprises multiple first compositions 22 and multiple second compositions 26 disposed in a plurality of individual compartments 30 within the mold channel 14. Each of the compartments is separated by a rupturable membrane 24. In some embodiments, opposite edge portions of the rupturable membranes 24 are secured to the forward wall 18 and rear wall 20 of dental shell 12. A lower edge portion of each rupturable membrane 24 is secured with the base wall 16. An upper edge portion of each rupturable membrane 24 is secured to a flexible membrane 28, which is adhered to portions of the dental shell 12, along peripheral edge portions of the flexible membrane 28, effectively enveloping the individual compartments 30 that are that are filled with the first compositions 22 and second compositions 26. In at least one embodiment, the individual compartments 30 contain an alternating pattern of first and second compositions. However, any arrangement of the first and second compositions may be envisioned in this application.

According to at least one embodiment of the present disclosure, such as depicted in FIG. 4, a self-contained dental form 32 comprises at least one first composition 22 and at least one second composition 26 separated by a rupturable membrane 24. In various embodiments, the dental form 32 would be contained within a flexible membrane 28 and the compositions would be isolated from each other by a rupturable membrane 24. The dental form 32 could be placed into the mold channel 14 of an exterior dental shell 12. In use, the user bites down on the insert 32, rupturing the internal rupturable membrane 24. The compositions are then allowed to mix together and at least partially cure. The finished mouthguard 10' would then release from the external dental shell 12 and function as a free-standing mouthguard 10' with minimal extra plastic bulk, similar to high end custom-lifted mouthguards.

According to the present disclosure, the user may engage the at least one first and second compositions by various methods, such as biting, bending/twisting the dental form prior to inserting into the user's mouth, pinching a particular point on the dental form prior to inserting into the user's mouth, and removing a mechanical clip. In at least one embodiment, the user may further shake or manipulate the dental form to engage mixing of the resin components. When the first and second compositions are mixed, the user would then place the dental form into the user's mouth and bite down against the dental form for a predetermined amount of time.

Depending on the materials and manufacturing cost of the technology, it is further contemplated that the mouthguard formed be disposable after a limited number of uses. This could be provided to athletes at low cost, while offering the athlete the ability to use a fresh mouthguard after a limited number of uses.

What is claimed is:

1. A custom fit mouthguard configured to absorb energy and reduce forces transmitted to a user's teeth, the mouthguard comprising:

a first composition;

a second composition; and a dental shell, having a base wall, forward wall, and rear wall that define a mold channel;

wherein the first composition and the second composition are: (i) encompassed by a flexible membrane that encloses the mold channel; (ii) disposed within the mold channel; and (iii) separated from one another; the flexible membrane being compressed by at least one mechanical clip in a manner that causes the flexible membrane to separate the first composition and the second composition from one another;

wherein the first composition and the second composition are characterized as being chemically reactable with one another to form a third composition in the dental shell.

2. The mouthguard of claim 1, wherein the first composition and the second composition are separated by at least one physical barrier.

3. The mouthguard of claim 2, wherein the at least one physical barrier is chosen from at least one rupturable membrane chosen from polyester, polycarbonate epoxy, acrylic, carbohydrates, chitin, chitosan, polystyrene, polyethylene, polypropylene, porous membranes, hydrophobic fiber mat, paper, non-woven polymer film, and mixtures thereof.

4. The mouthguard of claim 2, wherein the at least one physical barrier is a naturally-formed interface between the first composition and the second composition.

5. The mouthguard of claim 1, wherein the flexible membrane is configured to permit mixing between the first composition and the second composition, within the mold channel, by mechanical manipulation after the at least one mechanical clip is removed from the mouthguard.

6. The mouthguard of claim 5, wherein the flexible membrane is configured to permit mixing of the first composition and the second composition, within the mold channel, as a result of the user biting down on the dental shell after the at least one mechanical clip is removed from the mouthguard.

7. The mouthguard of claim 5, wherein the flexible membrane is configured to permit mixing of the first composition and the second composition, within the mold channel, as a result of removal of the at least one mechanical clip.

8. The mouthguard of claim 1, wherein the mouthguard comprises at least one indicator to signal to the user that mixing of the two compositions has begun.

9. The mouthguard of claim 8, wherein the at least one indicator is a visual indicator of color or luminescence chosen from organic acids, low pH indicators, metal salts and complementary ligands thereof, light absorbing molecules, fluorescent and phosphorescence emitting molecules, and chemiluminescent molecules.

10. The mouthguard of claim 8, wherein the first composition comprises one color indicator, the second composition comprises a second color indicator, and the third composition comprises a third color indicator.

11. The mouthguard of claim 1, wherein the dental shell comprises at least one reinforcement element.

12. The mouthguard of claim 11, wherein the at least one reinforcement element is chosen from thermoplastic materials.

13. The mouthguard of claim 1, wherein the first composition and the second composition comprise at least one reactant component chosen from epoxy-based resins, polyurethane resins, acrylic polymers, silicones, polyethylene glycol, polysaccharides, polycaprolactone, derivatized polycaprolactone, polymers crosslinked with at least one catalyst, cement, metals, semi-metal oxides, metal salts, metal-ion-crosslinked polymers, water-dispersible polymers, hydrogels, proteins, clay, water, and mixtures thereof.

14. The mouthguard of claim 13, wherein the first composition and the second composition comprise the same or different at least one reactant component.

15. The mouthguard of claim 1, wherein the flexible membrane is chosen from silicone rubber, polyurethane, polycaprolactone, synthetic rubber, nylon, and mixtures thereof.

16. The mouthguard of claim 1, wherein the first composition and the second composition are completely separated in the dental shell.

17. The mouthguard of claim 1, wherein the first composition and the second composition are encompassed by the flexible membrane and removably disposed within the mold channel of the dental shell.

18. The mouthguard of claim 1, wherein the mouthguard has a thickness of less than or equal to about 2 mm in at least one section of the dental shell.

19. The mouthguard of claim 1, wherein the first composition and the second composition form a third composition that exhibits a deformably resilient Shore A hardness less than or equal to 30.

* * * * *